US005969485A

United States Patent [19]

Hunt

[11] Patent Number: 5,969,485

[45] Date of Patent: Oct. 19, 1999

[54] USER INTERFACE FOR A LIGHTING SYSTEM THAT ALLOWS GEOMETRIC AND COLOR SETS TO BE SIMPLY RECONFIGURED

[75] Inventor: Mark A. Hunt, Birmingham, United Kingdom

[73] Assignee: Light & Sound Design, Ltd., Birmingham, United Kingdom

[21] Appl. No.: 08/753,035

[22] Filed: Nov. 19, 1996

[51] Int. Cl.[6] ..... H05B 37/02

[52] U.S. Cl. ..... 315/292; 315/316; 315/294; 315/297; 315/324

[58] Field of Search ..... 315/316, 314, 315/294, 297, 292, 324

[56] References Cited

U.S. PATENT DOCUMENTS

| | | | |
|---|---|---|---|
| 3,706,914 | 12/1972 | Van Buren | 315/316 |
| 3,766,431 | 10/1973 | Isaacs | 315/316 |
| 3,784,875 | 1/1974 | Baker et al. | 315/316 |
| 4,358,715 | 11/1982 | Dinges et al. | 315/316 |
| 5,010,459 | 4/1991 | Taylor et al. | 315/316 |
| 5,530,322 | 6/1996 | Ference et al. | 315/316 |
| 5,621,282 | 4/1997 | Haskell | 315/316 |
| 5,668,537 | 9/1997 | Chansky et al. | 315/316 |

OTHER PUBLICATIONS

Epperson "A Digital Lighting System for the Theatre". Theasn Yale School of Drama 1974.

*Primary Examiner*—Michael B Shingleton
*Attorney, Agent, or Firm*—Fish & Richardson P.C.

[57] ABSTRACT

Lamps forming a lighting show are grouped into maps. Each map includes an association between the lamps and specific sets. Lamps are in particular sets in particular maps and can be in different sets in other maps. Each set can be associated with a parameter for that set. One such parameter is the color for the set of lamps. Both maps and parameters can be changed by a single key press. This allows single key press parameter cycling.

17 Claims, 4 Drawing Sheets

| | (SET) | (LAMPS) |
|---|---|---|
| | 1 | 0, 1, 2 |
| 119 | 2 | 3, 4, 5 |
| 118 | 3 | 6, 7, 8 |
| 116 | 4 | 9, A, B |
| 114 | 5 | C, D, E |
| 112 | 6 | F, 10 |
| 110 | 7 | 11, 12 |

Fig 3A

| | (SET) | (LAMPS) |
|---|---|---|
| 210 | 1 | 2, 5, 8, B, E |
| 212 | 2 | 1, 4, 7, A, D |
| 214 | 3 | 0, 3, 6, 9, C |
| 110 | 4 | F, 10 |
| 112 | 5 | 11, 12, 13 |

Fig 3B

| PALETTE | COLOR | SET |
|---|---|---|
| 1 | 00 | 1 |
| | 0A | 2 |
| | 06 | 3 |
| | 1F | 4 |

| PALETTE | COLOR | SET |
|---|---|---|
| 2 | 01 | 1 |
| | 0B | 2 |
| | 0F | 3 |
| | 3F | 4 |

Fig 4

USER INTERFACE FOR A LIGHTING SYSTEM THAT ALLOWS GEOMETRIC AND COLOR SETS TO BE SIMPLY RECONFIGURED

FIELD OF THE INVENTION

The present invention relates to a combination driver for grouping stage lighting parameters into sets within maps and allowing changing the combinations formed by the contents of the parameters and the maps. More specifically, the preferred embodiment describes a plurality of luminaires which are dynamically arranged in maps, each map assigning the luminaires to specific sets, and the parameters being color palettes assigning colors to the sets.

BACKGROUND AND SUMMARY

Stage lighting is increasingly becoming an important part of theatrical productions, such as rock and roll concerts or theater presentations. A modern stage lighting effect uses a computer to choreograph the lighting effects to be initiated and carried out at pre-planned times. The choreographed effect has usually been planned in advance.

The choreographed effect is usually planned between the artist, often the lighting designer, and the console operator. A dry run through the show is conducted while the lighting designer decides what lighting effects are desired at different parts of the show.

The console operator controls the lighting system according to the lighting designer's direction, and by so doing plans the lighting effects that occur at different times during the show. Those lighting effects need to be carried out by the console operator.

The lighting designer will often want to try different effects to see what they look like and how they will fit in. Each attempted effect requires the console operator to arrange the operation of each light in the way that the lighting designer has requested.

For example, the lighting designer may have in mind a certain effect to be carried out in primary colors. If there is a desire to see what certain parts of that effect would look like in pastel colors, the console operator will need to change a number of different sets of lights to pastel colors. The console operator needs to do this as quickly as possible, but each light may need to be seperately controlled.

The present invention recognizes this problem, and devises a system which enables simple button presses on the console to command combinations of effects to facilitate the console operator's chore during this operation. One such feature allows cycling through many different kinds of lighting effects and grouping effects.

Present technology has necessitated that most, if not all, lighting shows be conducted automatically, based on information that has been stored in advance. This has made it difficult to improvise the lighting effect during a lighting show.

According to one aspect of the present invention, a number of stage lights form a show. The stage lights are defined into at least two different maps. Each map includes a set assignment for each of the stage lights. Each map includes at least some of the different stage lights in different sets.

A parameter palette is formed which includes parameters for the different sets. A preferred parameter palette is a color palette. For example, a primary color palette could change all of the lights in set 1 to red, the lights in set 2 to green, and the lights in set 3 to blue. A pastel palette, on the other hand, changes the lights in set 1 to pastel pink, the lights in set 2 to pastel blue, and the lights in set 3 to pastel green. Other different palette sets are also possible. Hence these different sets have different colors associated with the lamps in the set, thereby allowing different combinations of lamps to colors.

When a specific palette is chosen, each color in the palette can be applied to a set in the current map. A particularly preferred technique allows each palette and each map to be changed by a single key press.

Another part of this technique rotates the combinations, i.e., it rotates the different sets through the colors within the palettes. Therefore, the different palettes, which include parameters of predetermined types, can be rotated through the different sets either at random or in an organized fashion to allow the different parameters to be assigned to different sets and to test that effect. The maps, i.e., the associations between the lamps and the groups, can be rotated in a similar way.

Another aspect groups the lamps forming a lighting show into maps. Each map includes an association between the lamps and specific sets. Lamps are in particular sets in particular maps, and can be in different sets in other maps. Each set can be associated with a parameter for that set. One such parameter is the color for the set of lamps. Both maps and parameters can be changed by an association changing device, e.g., a single key press. This allows single key press parameter cycling.

All of these operations are automatically carried out using simple keystrokes to form the different combinations. This hence allows the associations to be carried out in a shorter time. No revenue is derived from this rehearsal time, hence increasing the economic incentive for shortening this time.

BRIEF DESCRIPTION OF THE DRAWINGS

These and other aspects of the present invention will be described with reference to the accompanying drawings in which:

FIGS. 3A and 3B show the stored memory information for these maps;

FIG. 4 shows a memory map of color pallette information; and

DESCRIPTION OF THE PREFERRED EMBODIMENTS

Figure 1:
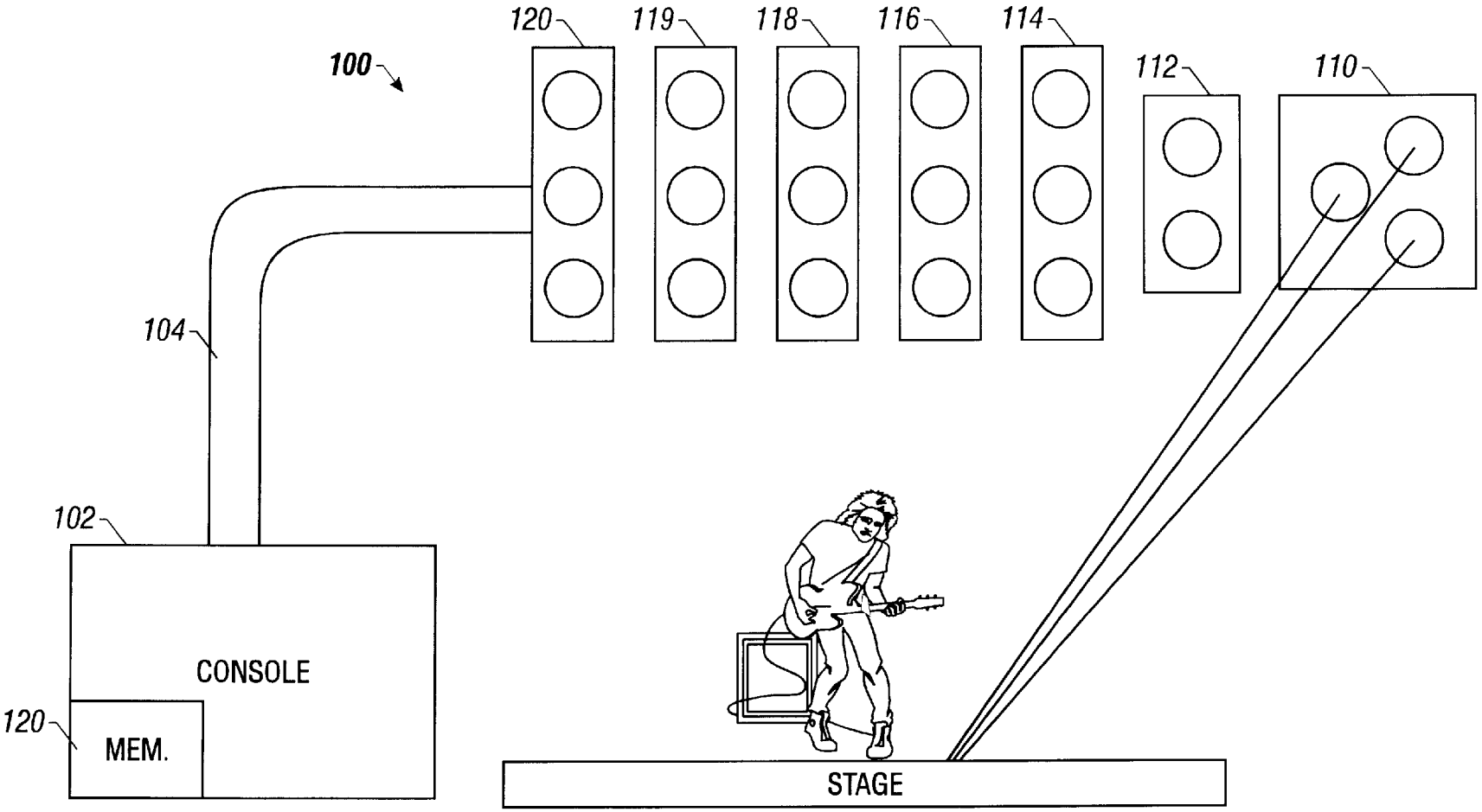
FIG. 1 shows a basic block diagram including a number of lights, their relationship with the stage, and their relationship with a console.

The basic system of the present invention is a stage lighting system as shown in FIG. 1. The FIG. 1 stage lighting system includes a lighting rig, which includes a group of luminaires ("lamps") forming a lighting show. The lighting rig 100 shown in FIG. 1 includes 20 lamps. In actual practice, a lighting show would actually include more than 20 lamps, but 20 is sufficient to illustrate the concept. The lighting rig 100 can be considered as a set of potential patterns.

Lighting rig 100 is controlled by console 102 through lighting cable 104. The preferred console is an ICON CONSOLE™ made by Light & Sound Design to control lighting rig 100 using Light & Sound Design's proprietary ICON™ format. However, any other console, including consoles available from other lighting companies could be used for this purpose.

The ICON CONSOLE™ 102 is a computer-based system which operates according to a stored program. The microcomputer used in this system is an M68000 which produces outputs according to the stored program. The outputs produces a control for each of the luminaires in the group. Each lamp receives commands to control its movement, position, color, specific light pattern to be projected (gobo), focus, dimmer, and iris. Any of these parameters, and any other parameters that are controlled by a lamp, could be controlled by forming the combinations described according to the present invention. The preferred embodiment described herein chooses the color parameter. However, it should be understood that any of these parameters could be controlled.

The entire lighting rig 100 is then arranged into predetermined maps. Each map is formed of a plurality of sets, and each set includes a number of different lamps—a pattern of lamps. Some of the sets may be formed of groups of lamps that are always used together, for example, set 110 may be a group of three lamps which shines on the same spot and hence would normally be used altogether. Other sets may be dynamically changed. Each map is essentially a view of the geometry of the lighting rig, with each subgeometry within the map being a set.

Each map is a group of sets. Each set is an association between the lamps and their set association. FIG. 1 shows the lighting rig 100 arranged into a first map. This map includes groups 110–120. Each of the lamps within the rig is assigned to a specific set.

Figure 2:
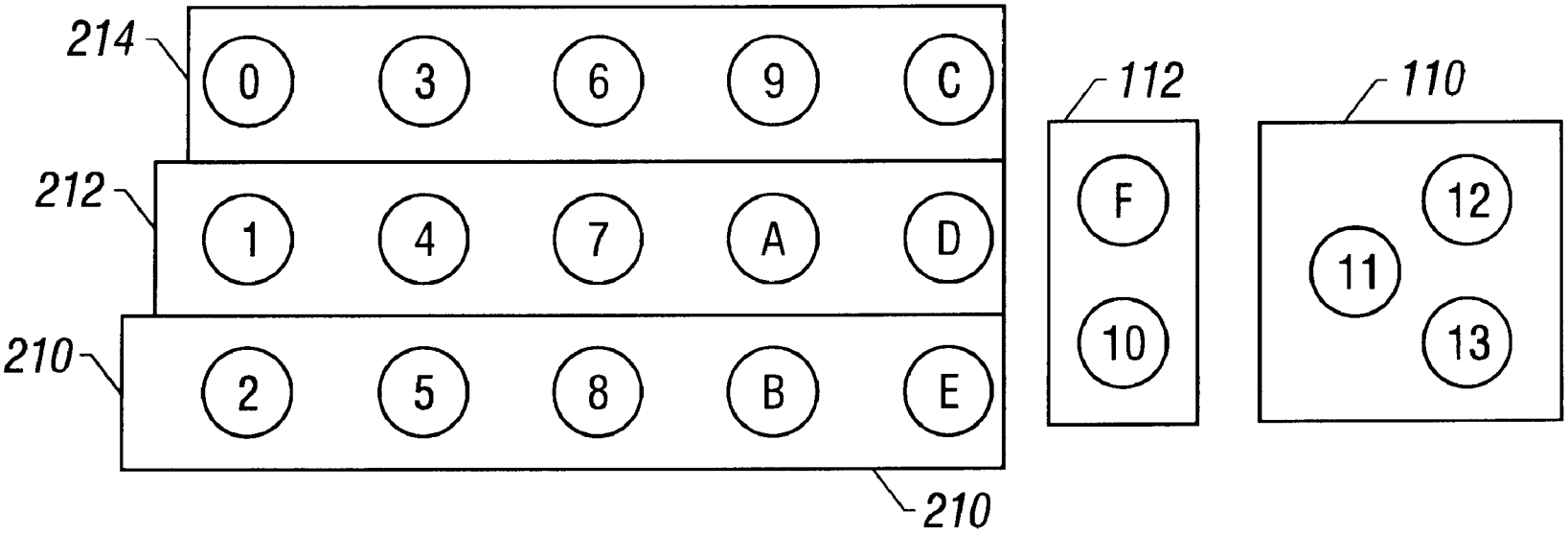
FIG. 2 shows an alternative map which groups the lamps into different sets.

FIG. 2 shows another map, which we will call map 2. Map 2 includes different set associations than map 1; some of the sets are the same as map 1 and others are different than map 1. Some of the lamps may be within the same set, such as sets 110 and 112 which are the same in map 1 and map 2. The other sets 210, 212, and 214 include different groupings for the lamps. Note that the different sets in map 2 form a different geometrical pattern than the geometrical patterns in set 1.

Of course, in actual practice there would be more than two maps.

The maps are assigned in advance and stored within the console memory, e.g., as computer data. Each lamp has a pre-assigned serial number. In this embodiment, the serial numbers, for simplicity, are designated as $0_H$ through $13_H$. The number of sets in this embodiment might be limited to $16(F_H)$, although there is no practical limit on the number of sets which could be assigned.

Memory 120 within console 102 stores a relationship between each set number $0_H$ through $F_H$ and the lamps within that set. For instance, the memory map for map 1 is shown in FIG. 3(*a*) and the memory map for map 2 is shown in FIG. 3(*b*).

A number of predefined palettes are also used according to the present invention. Each palette has multiple values defining a whole set of parameters, here a whole set of colors. Each parameter, for example, has a number of different forms.

According to the present invention, 256 different colors are defined. Each of the colors is assigned with a number. Each number represents a specific color that is available from the ICON™ lamp. The colors may range between 0 and $FF_H$.

The palettes are groups of colors which are in some way related to one another. Exemplary palettes include primary color palettes, such as red, green, blue; pastel color palettes; highly saturated palettes; weakly saturated palettes; rainbow palettes of colors that form a rainbow; random color palettes, single-color palettes, such as differing hues of red, differing hues of blue; dual-and triple-color palettes; and any other palette of lights that might go together. Each palette can include up to 16 colors.

The basic color palette that is stored in memory is shown in FIG. 4. The memory map includes information for the different numbered palettes. Note that each color in the FIG. 4 color palette is associated with a set number.

Figure 5:
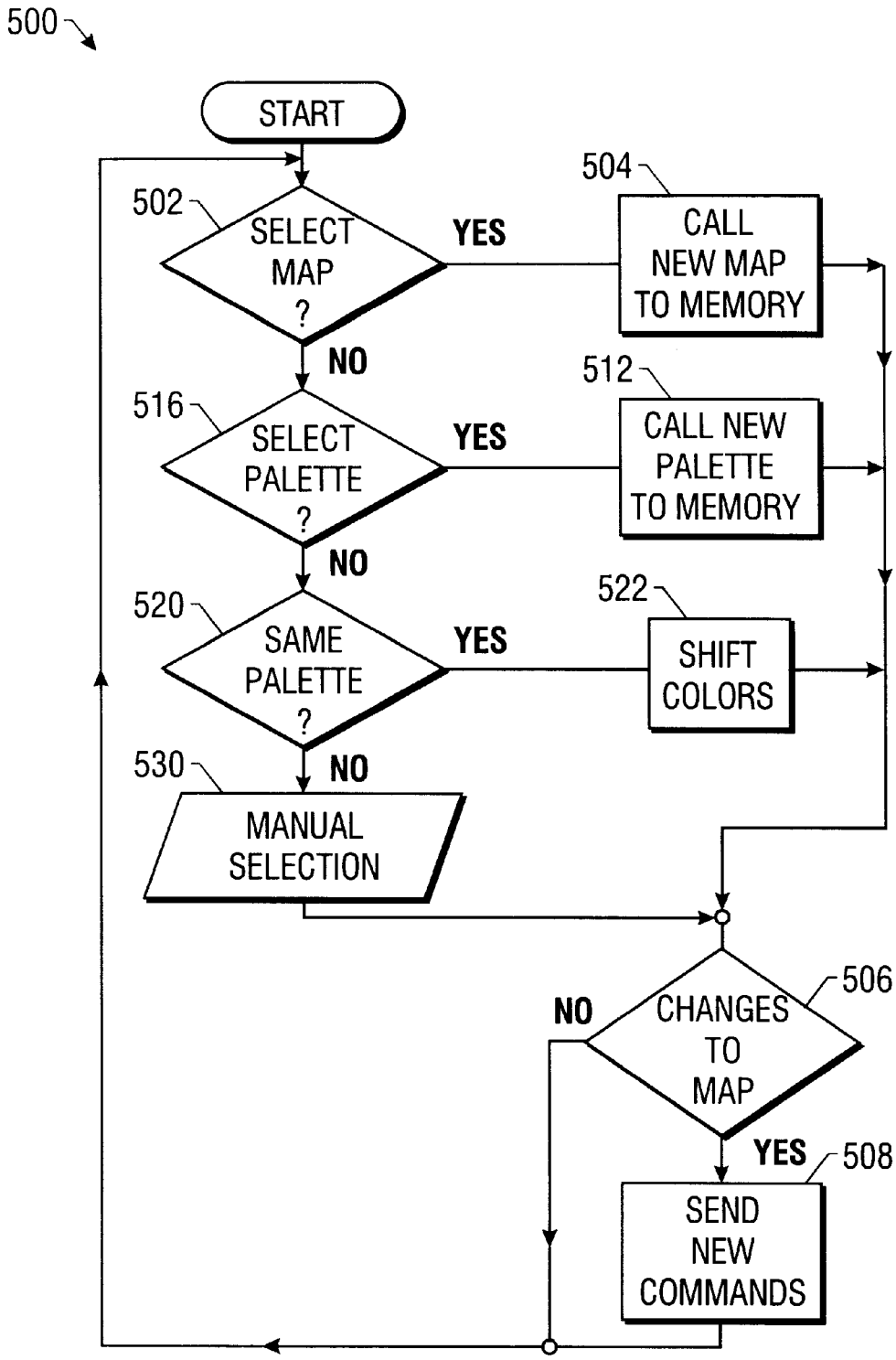
FIG. 5 shows a flowchart of operation of the combination forming technique of the present invention.

The operation of operating the lights is shown in the flowchart of FIG. 5. Step 500 starts the process with a determination at step 502 whether a selection of map has been requested. If so, the new map is called into memory at step 504. The map stored in memory is of the form shown in FIGS. 3A and 3B—the table includes the serial number of each lamp, and its set association for various parameters of that lamp, including, but not limited to, color, focus, position, and the like. Control then passes to the map change operation steps. Step 506 determines if there are any changes to the memory. If changes are detected, appropriate messages are sent at step 508 commanding the lamps to their new color. Flow then returns to the main loop.

Step 510 determines a selection of a palette. If there is a selection of a new palette at step 510, the palette is called to working memory at step 512. Control then passes to the change detection routine, which processes the changes according to steps 506 and 508.

This results in a lamp-table state in which the default combinations of the selected palette as shown in FIG. 4 has been associated with the sets within the selected maps. Now the colors can be changed in a number of different ways. Step 520 represents selecting the same palette again. Reselection of this same palette causes the same palette to be used, but the colors to set combinations to shift. This can be carried out in a number of different ways according to the present invention. The most preferred way is by Fourier-bit swapping. Each of the colors is associated with a set and a Fourier technique is used to rearrange the bits within the set so that each color is in a definable, yet pseudo-random way, associated with a different set.

In the event that there are less colors than there are a number of sets, the colors can be simply re-used for the new sets. In the opposite scenario, where there are fewer sets than colors, certain of the colors within the palette will be unused at different times.

Another alternative for cycling is a hash algorithm.

Another technique, less preferred but also useable, is to use a pseudo-random number generator to select numbers between 0 and $F_H$. Yet another technique simply shifts the relationship between the colors and the sets in an ordered fashion so that the color previously associated with set 1 is now associated with set 2, and the color previously associated with set f becomes with set 0.

Yet another technique uses a factorial association technique. N colors have N! different available combinations. The N! combinations are associated with the different sets.

At step 522, the shifted colors are defined into working memory, followed by the change processing routine of steps 506/508.

Step 530 enables manual selection of certain groups/colors. This selection allows certain sets to be manually selected. Those manually-selected groups are maintained at the manually-selected color until cancelled. The other group combinations can be shifted using the same technique previously described.

Any desired effect includes a number of elements within memory stored as a table. That table can then be stored as a cue for the desired effect.

Although only a few embodiments have been described in detail above, those having ordinary skill in the art will certainly understand that many modifications are possible in the preferred embodiment without departing from the teachings thereof.

All such modifications are intended to be encompassed within the following claims.

What is claimed is:

1. A stage lighting system, comprising:

a plurality of electrically-controllable lights, each including a control path over which said lights can be commanded from a remote location; and a controller, connected to said lights and electrically controlling said lights according to a stored program and user interface, said controller including:

a memory, storing a plurality of maps for said lights, each of said maps assigning said lights to light sets and at least a plurality of said light sets including more than one light, and a plurality of parameter sets of light-controlling parameters for said light sets including a pallette of colors for said light set, an association between light set parameters from said parameter sets which are associated with said light sets, said controller commanding said lights in each said light set based on the parameters associated with the light sets, and said user interface including an association changing device, which has a first keypress which selects and changes at least one of said maps in said memory which is being used, said map being selected to select all of the groupings of lights to light sets in that map at one time said first key press cycling through maps with a single key press causing a single cycling, and an association between said sets and colors in said pallette which is selected according to a single key press all one to cycle through an association between light sets and parameters.

2. A system as in claim 1, wherein said association changing device is a button, which when pressed, changes said at least one of said maps and said sets.

3. A variable lighting system, comprising:

a plurality of lights;

a memory, storing at least two different maps, each said map assigning said lights to sets, each map includes at least some of the different lights in different sets, and said memory including a plurality of parameters associated with said sets including at least first and second different color palletes each of which is group of colors used together; and a controller, having a first control element allowing selection of one of said maps controlling said lights such that each said set is controlled by the parameters associated with said each set for all of one map when selected, and a second control element which controls cycling between said first and second color pallettes, a first association between said map and said first color pallette, and a single key press changing said association to between said map and said second color palette.

4. A system as in claim 1, wherein a first color palette includes primary colors, and a second color palette includes colors other than primary colors.

5. A system as in claim 1, wherein said association changing device is a key, and each step in the rotation is commanded by a single key press.

6. A system as in claim 3, wherein said parameters include at least movement, position, color, specific light pattern to be projected (gobo), focus, dimmer, and iris.

7. A system as in claim 3, wherein said map stores a numerical value associated with each parameter.

8. A system as in claim 7, wherein said map stores an association between a numerical value indicating a specific light, and the numerical value associated with each parameter.

9. A system as in claim 3, wherein said parameter set is a palette with specific colors; each color being associated with one of said sets from a selected map.

10. A variable lighting system, comprising:

a plurality of lights;

a memory, storing a first geometrical arrangement of said lights, and a second geometrical arrangement of said lights different than said first geometrical arrangement of said lights, each geometrical arrangement of lights including subgeometries therein, and said memory storing an association between at least one subgeometry among said subgeometries and a parameter for said one subgeometry; and a changing element, allowing changing a parameter which is associated with all lights in said subgeometry using a single key press.

11. A system as in claim 10, further comprising a controller, controlling said lights such that each said subgeometry is controlled by the parameter associated with said each subgeometry.

12. A method of controlling a variable lighting system, comprising:

assigning each of a plurality of lights to respective sets;

associating one of a plurality of parameters with each said set;

using a parameter key press to rotate the association between the parameters and the sets; and controlling said lights such that each said set is controlled by the parameter associated with said each set.

13. A system as in claim 3, wherein said parameter set is a palette with specific colors; each color being associated with one of said sets from a selected map.

14. A method as in claim 12, further comprising changing a set of parameters which forms said plurality of parameters.

15. A method as in claim 12, wherein said plurality of parameters is a color palette.

16. A method as in claim 12, wherein said assigning comprises storing an association between a numerical value indicating a specific light, and a numerical value associated with each parameter.

17. A method of controlling a variable lighting system, comprising:

assigning each of a plurality of lights to respective sets;

associating light controlling parameters with said sets;

changing an assignment between lights and sets to change the light controlling parameter associating between said sets and said parameters; and controlling said lights such that each said set is controlled by the parameter associated with said each set.

* * * * *